US007814678B2

(12) United States Patent
Romanek

(10) Patent No.: US 7,814,678 B2
(45) **Date of Patent: *Oct. 19, 2010**

(54) HEARING AID DRYER

(75) Inventor: Harvey Romanek, St. Petersburg, FL (US)

(73) Assignee: Hearing Technologies International, Inc., Pinellas Park, FL (US)

( * ) Notice: Subject to any disclaimer, the term of this patent is extended or adjusted under 35 U.S.C. 154(b) by 173 days.

This patent is subject to a terminal disclaimer.

(21) Appl. No.: 12/249,578

(22) Filed: Oct. 10, 2008

(65) Prior Publication Data

US 2010/0088916 A1 Apr. 15, 2010

(51) Int. Cl.
*F26B 19/00* (2006.01)
*F26B 25/06* (2006.01)
*F26B 25/00* (2006.01)

(52) U.S. Cl. ..... 34/202; 34/232; 34/235; 34/239; 34/87

(58) Field of Classification Search ..... 34/87, 34/201, 202, 218, 232, 235, 239
See application file for complete search history.

(56) References Cited

U.S. PATENT DOCUMENTS

| | | | | |
|---|---|---|---|---|
| 5,640,783 | A | 6/1997 | Schumaier | |
| 5,852,879 | A | 12/1998 | Schumaier | |
| 7,017,276 | B2 | 3/2006 | Greenspan et al. | |
| 2009/0296968 | A1 * | 12/2009 | Wu et al. | 381/323 |
| 2010/0088922 | A1 * | 4/2010 | Romanek | 34/275 |

* cited by examiner

*Primary Examiner*—Jiping Lu
(74) *Attorney, Agent, or Firm*—Larson & Larson, P.A.; Frank Liebenow

(57) ABSTRACT

An application for a hearing aid drying/disinfecting system includes a closable container with an internally mounted ultra-violet lamp for disinfecting the hearing aid. A heating element creates an internal temperature that is higher than ambient temperature and a fan circulates air through shielded vents from the outside of the container through the container and back out, thereby drying the hearing aid contained within the drying/disinfecting system.

20 Claims, 7 Drawing Sheets

HEARING AID DRYER

FIELD OF THE INVENTION

This invention relates to an appliance for reducing moisture damage to sensitive electronic devices and more particularly to an appliance for reducing moisture in hearing aids.

BACKGROUND

Current trends in electronics have enabled the production of hearing aids small enough to reside partially or completely in the ear canal. This exposes the devices to a warm, humid environment and presents the opportunity for damage to the device and ultimately, failure of the device.

There are several ways for hearing aid wearers to protect their devices from moisture damage while they are not being worn. The simplest device is a container having desiccant material inside and way to separate the device from the desiccant.

U.S. Pat. No. 5,640,783 to Schumaier, U.S. Pat. No. 5,852,879 to Schumaier and U.S. Pat. No. 7,017,276 to Greenspan, et al, describes both drying and bactericidal activity in their devices. These devices utilize a fan to circulate air internally within the unit and have a heater to assist in moisture removal. Since the air is circulated internally, a desiccant material is used to absorb moisture from the air. At some point, the desiccant material used in the above-described devices becomes saturated with moisture and needs to be either replaced with a fresh desiccant or regenerated by heating it to a high temperature. The desiccant material is regenerated by exposure to very high temperatures, usually in excess of 100 degrees Celsius.

What is needed is a de-moisturizing appliance that does not require a desiccant material to reduce moisture in a contained electronic device.

SUMMARY OF THE INVENTION

An electronic device drying and disinfecting apparatus includes a closable container of enclosure with an internal ultra-violet lamp for disinfecting the electronic device. A heating element creates an internal temperature that is higher than ambient temperature and a fan circulates air from the outside of the container through the container and back out, thereby drying the electronic device.

In one embodiment, a drying system for a hearing aid is disclosed including an enclosure having a lid portion hingedly connected to a base portion with a ultra-violet lamp (e.g., a germicidal ultra-violet lamp) adapted to emit ultra-violet light within the enclosure. At least some of the ultra-violet light is directed towards the hearing aid. A shelf situated in the base portion supports the hearing aid and a heater within the base portion and beneath the shelf heats the hearing aid. At least two air vents are formed in the base portion, each of the at least two air vents comprise an inner air vent and an outer air vent, whereas the inner air vent is staggered with respect to the outer air vent, thereby allowing air flow while reducing leakage of the ultra-violet light. A fan is located within the base portion, drawing air into the drying system through a first air vent of the at least two air vents and pushing air out of the drying system through a second air vent of the at least two air vents.

In another embodiment, a drying system for a hearing aid is disclosed including an enclosure having a lid portion hingedly connected to a base portion and a ultra-violet lamp (e.g., a germicidal ultra-violet lamp) adapted to emit ultra-violet light within the enclosure. At least some of the ultra-violet light is directed towards the hearing aid. A shelf situated in the base portion supports the hearing aid and a heater within the base portion and beneath the shelf heats the hearing aid. At least two air vents are formed in the base portion, each of the at least two air vents comprise an inner air vent and an outer air vent, whereas the inner air vent is staggered with respect to the outer air vent, thereby reducing leakage of the ultra-violet light. A fan is located within the base portion, drawing air into the drying system through a first air vent of the at least two air vents and pushing air out of the drying system through a second air vent of the at least two air vents. A timer is interfaced between a power source and the fan, the heater and the ultra-violet lamp. The timer connects power to the fan, the heater and the ultra-violet lamp during a timer interval. An interlock switch is interfaced between the power source and the fan, the heater and the ultra-violet lamp; the interlock switch is operatively coupled between the lid portion and the base portion and the interlock switch disconnects the power source from the fan, the heater and the ultra-violet lamp responsive to the interlock switch detecting a separation between the lid portion and the base portion (e.g., opening of the lid).

BRIEF DESCRIPTION OF THE DRAWINGS

The invention can be best understood by those having ordinary skill in the art by reference to the following detailed description when considered in conjunction with the accompanying drawings in which.

DETAILED DESCRIPTION

Figure 1:
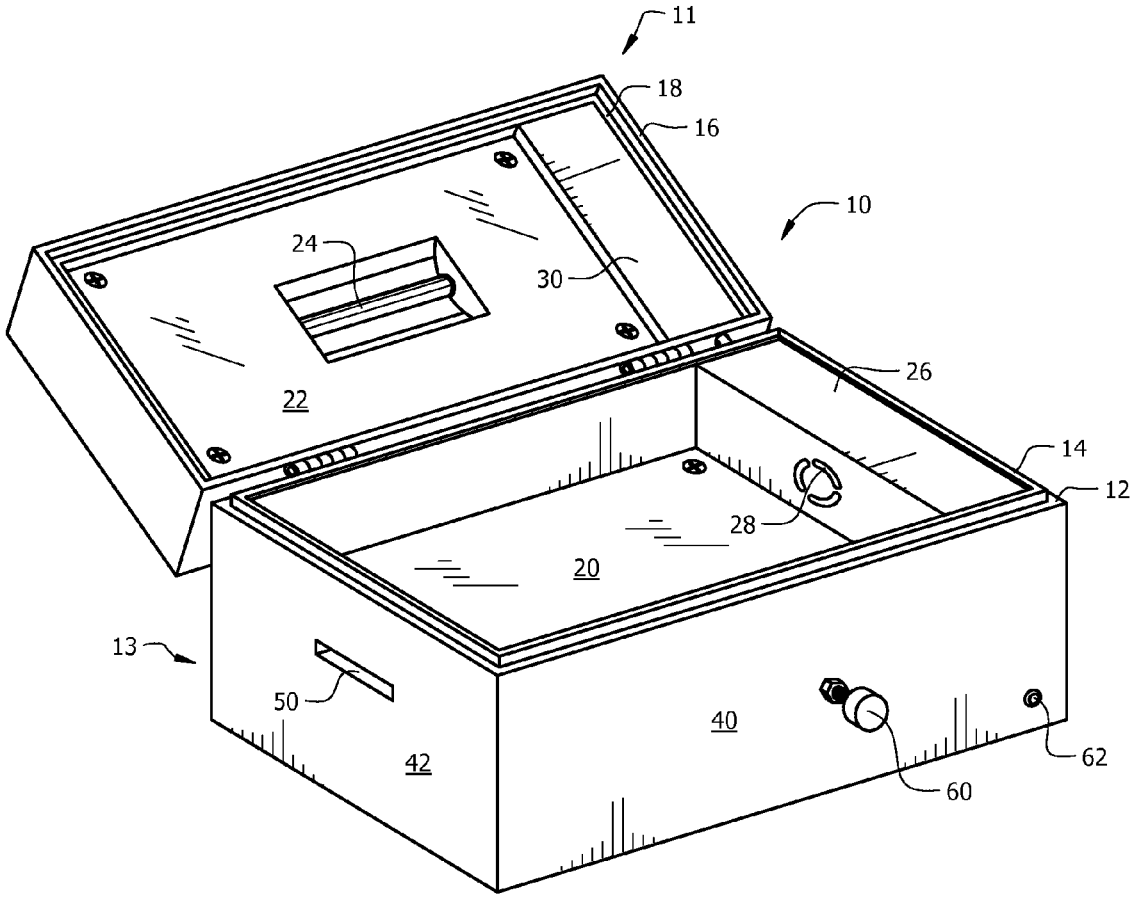
FIG. 1 illustrates a perspective view of an exemplary system of the present invention with the lid open.

Reference will now be made in detail to the presently preferred embodiments of the invention, examples of which are illustrated in the accompanying drawings. Throughout the following detailed description, the same reference numerals refer to the same elements in all figures.

Figure 2:
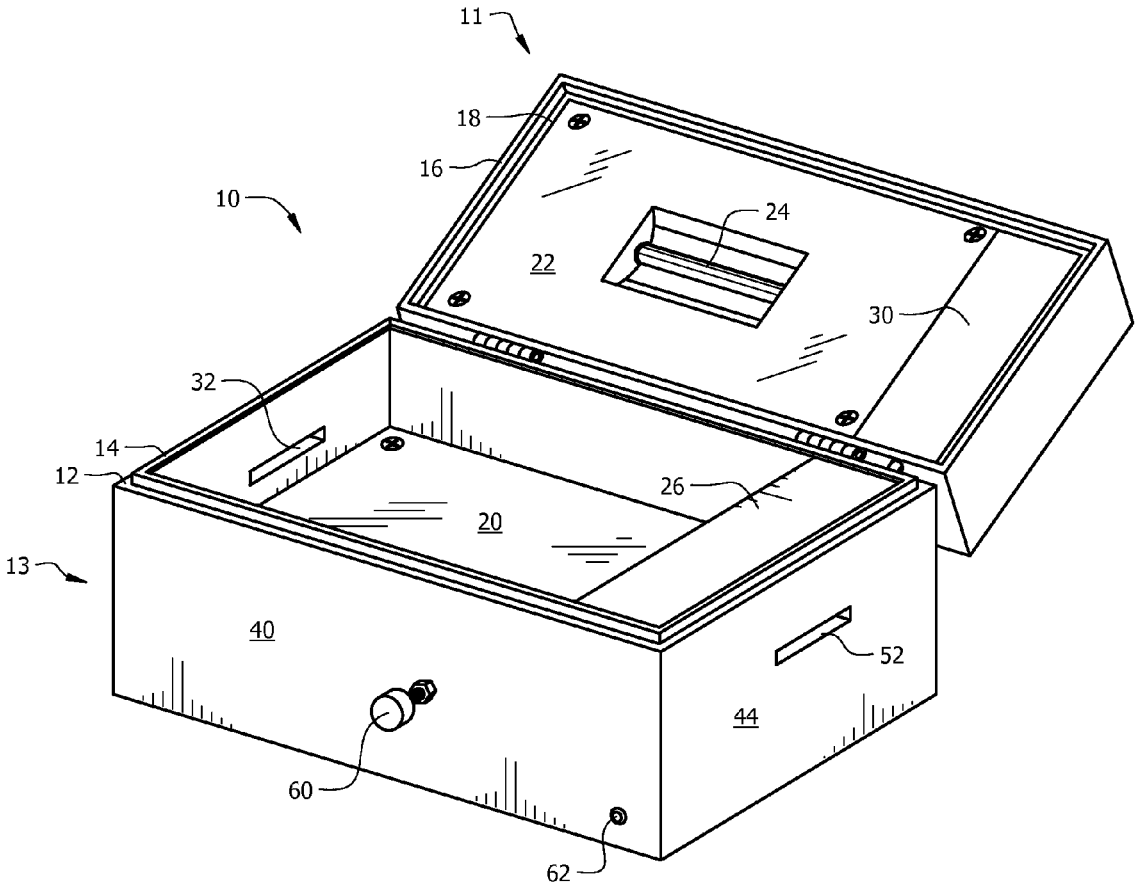
FIG. 2 illustrates a second perspective view of the exemplary system of the present invention with the lid open.

Referring to FIGS. 1 and 2, perspective views of an exemplary system 10 of the present invention with the lid open is shown. The hearing aid dryer 10 dries and disinfects a hearing aid 99 (see FIG. 6) or other electronic device using heat, a germicidal ultra-violet light and air flow without the use of a desiccant. Existing hearing aid dryers require a desiccant to remove humidity/moisture from within their sealed enclosure. The hearing aid dryer 10 performs its function without the use of a desiccant.

The hearing aid dryer 10 has a base portion 13 with a lid portion 11 hingedly attached to the base 13. The lid 11 contains an ultra-violet lamp 24 such as germicidal ultraviolet lamps as known in the industry. The ultra-violet lamp 24 emits ultra-violet light onto the hearing aid 99 (see FIG. 6) as it sits on a shelf 20, thereby disinfecting the hearing aid 99. In the preferred embodiment, the shelf 20 has a mirrored surface facing upward and the upper shelf 22 of the lid 11 has a mirrored surface facing downward to both intensify the ultra-violet light from the ultra-violet lamp 24 and to provide ultra-violet light at many different angles to reach within openings of the hearing aid 99.

A fan 81 (see FIG. 3) is positioned beneath a ledge cover 26 of the base 13. The fan 81 vents air through a fan grill 28 and in or out a vent hole 52. Although the system 10 works well with the fan 81 blowing either in or out, it is preferred the fan 81 blows out through the vent hole 52 to exhaust humidity. In the preferred embodiment, air flows in through a vent hole 50 on the side 42 of the base 13 and flows out of the vent hole 52 on the opposite side 44. In another embodiment, air flows in through a vent hole 52 on the side 44 of the base 13 and air flows out of the vent hole 50 on the opposite side 42. Although it is preferred that the vent holes 50/52 as shown (on opposite side surfaces 42/44), in alternate embodiments, the vent holes 50/52 are on other surfaces. Although two vent holes 50/52 are shown, any number of vent holes 50/52 are anticipated in any shape and size.

The vent hole 50 is coupled to an internal vent hole 32 through a channel within the side 42 such to provide protection from ultra-violet light escaping, being that ultra-violet light is harmful to one's eyes. A similar channel couples vent hole 52 to another internal vent hole 33 (see FIG. 3).

Although the internal vent holes 32/33 and the external vent holes 50/52 are fabricated in any way currently known, a preferred method of staggering the internal vent holes 32/33 from the external vent holes 50/52 is by using an inner base 14 and an outer base 12. The internal vent holes 32/33 are cut or formed in the inner base 14 and external vent holes 50/52 are cut or formed in the outer base 12. Likewise, although the lid 11 is anticipated to be made in any way known in the industry, it is preferred that the lid be made of an inner lid 18 and an outer lid 16. To reduce emissions of ultra-violet light, the inner lid 18 is recessed from the outer lid 16 and the inner base 14 extends beyond the edge of the outer base 12, thereby providing a staggered interface to each other to seal the lid portion 11 to the base portion 13, thereby reducing ultra-violet light emissions outside of the system 10.

In some embodiments, an on/off switch 60 and an indicator 62 are provided on an outside surface such as the front surface 40. In some embodiments, a lid deck 30 covers part of the interlock switch (see FIG. 3).

Figure 3:
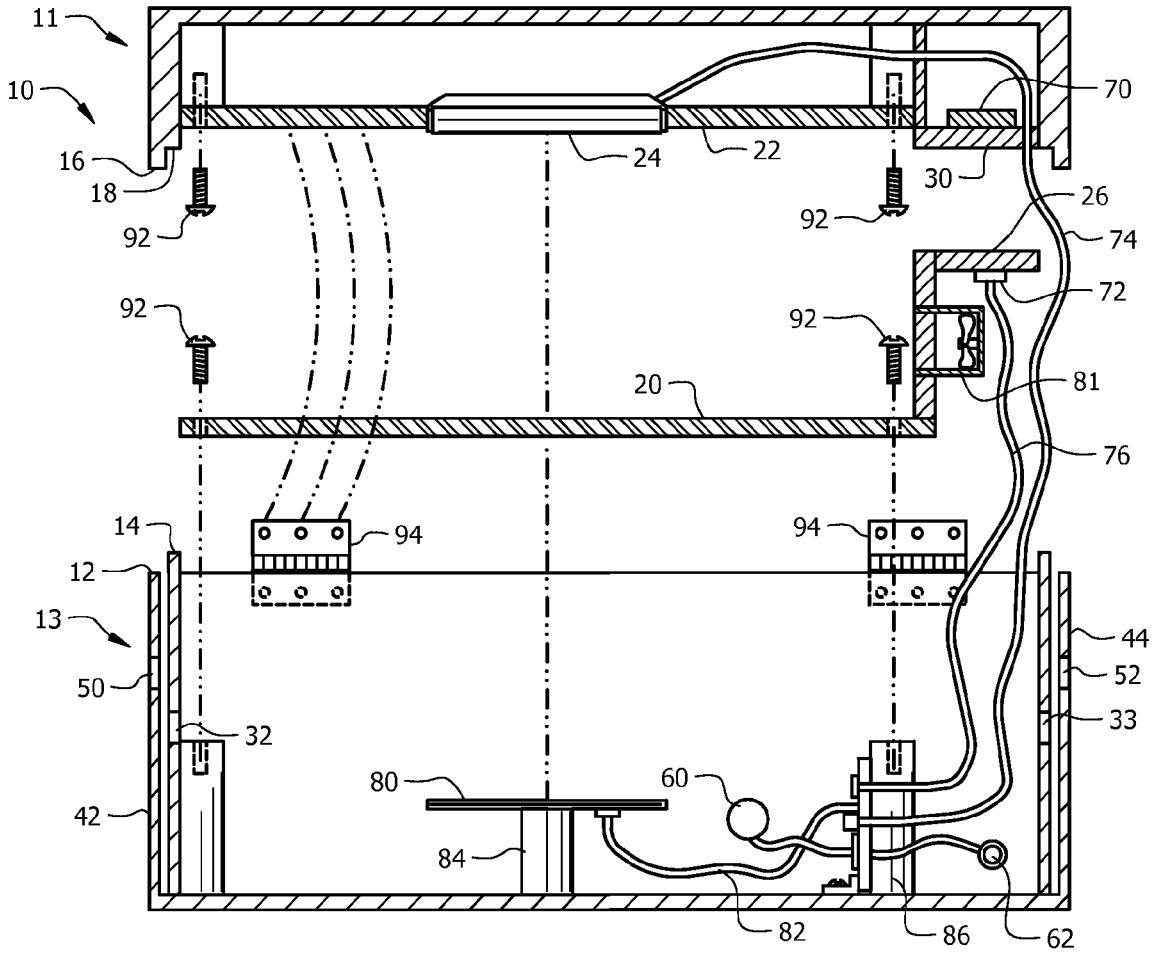
FIG. 3 illustrates a plan view of the exemplary system of the present invention.

Referring to FIG. 3, a plan view of the exemplary system of the present invention is shown. The hearing aid dryer 10 has a base portion 13 with a lid portion 11 attached to the base 13 by, for example, hinges 94. The lid 11 contains an ultra-violet lamp 24 that shines ultra-violet light to disinfect the heating aid 99 (see FIG. 6) as it sits on a shelf 20. In the preferred embodiment, the shelf 20 has a mirrored surface facing upward and the upper shelf 22 of the lid 11 has a mirrored surface facing downward to both intensify the ultra-violet light from the ultra-violet lamp 24 and to provide ultra-violet light at many different angles to reach within openings of the hearing aid 99. The shelf 20 and upper shelf 22 are fastened to the lid 11 and base 13 with screws 92 or are affixed in any other way known.

A fan 81 is positioned beneath the ledge cover 26 of the base 13. The fan 81 blows air through a fan grill 28 (see FIGS. 1 and 2) and in or out a vent holes 52/33. Although the system 10 works well with the fan 81 blowing either in or out, it is preferred the fan 81 blows out through the vent holes 52/33 to exhaust humidity. In the preferred embodiment, air flows in through vent holes 50/32 on the side 42 of the base 13 and flows out of the vent hole 52/33 on the opposite side 44. In another embodiment, air flows in through a vent hole 52/33 on the side 44 of the base 13 and air flows out of the vent hole 50/32 on the opposite side 42. Although it is preferred that the vent holes 50/52 are shown on opposite side surfaces 42/44, in alternate embodiments, the vent holes 50/32/52/33 are on other surfaces. Although two vent holes 50/32/52/33 are shown, any number of vent holes 50/32/52/33 are anticipated in any shape and size.

The vent hole 50 is coupled in a staggered configuration to an internal vent hole 32 through a channel within the side 42 to provide protection from ultra-violet light escaping, being that ultra-violet light is harmful to one's eyes. In this way, since light and ultra-violet light do not naturally bend, very little ultra-violet light is emitted out of the vent hole 50 (it is possible for a harmless, very small amount of reflected ultra-violet light to escape). A similar channel couples vent hole 52 to the other internal vent hole 33.

Although the internal vent holes 32/33 and the external vent holes 50/52 are fabricated in any way currently known, a preferred method of staggering the internal vent holes 32/33 from the external vent holes 50/52 is by using an inner base 14 and an outer base 12. The internal vent holes 32/33 are cut or formed in the inner base 14 and external vent holes 50/52 are cut or formed in the outer base 12. Likewise, although the lid 11 is anticipated to be made in any way known in the industry, it is preferred that the lid be made of an inner lid 18 and an outer lid 16. To reduce emissions of ultra-violet light, the inner lid 18 is recessed from the outer lid 16 and the inner base 14 extends beyond the edge of the outer base 12, thereby providing a staggered pair of interface edges that seal and reduce ultra-violet light emissions.

To prevent operation of the ultra-violet light when the hearing aid dryer 10 is opened, an interlock is provided. In the example shown, the interlock comprises a magnet 70 and a magnet sensing switch 72, for example, a reed switch. The magnet sensing switch 72 is coupled to the main circuit board 86 through wires 76. When the magnet sensing switch 72 detects a reduction of magnetic field from the magnet 70 (e.g., the lid 11 is opened slightly), circuitry on the main circuit board 86 prevents the flow of electricity through wires 74 to the ultra-violet lamp 24.

In some embodiments, an on/off switch 60 and an indicator 62 are provided on an outside surface such as the front surface 40 and are connected to the main circuit board 86.

A heating element 80 is powered through wires 82 connecting it to the main circuit board 86. The heating element 80 is any known heating element such as a resistive heating element or a semiconductor heating element, etc. In some embodiments, the heating element 80 is held close to the shelf 20 by a stand-off 84.

Figure 4:
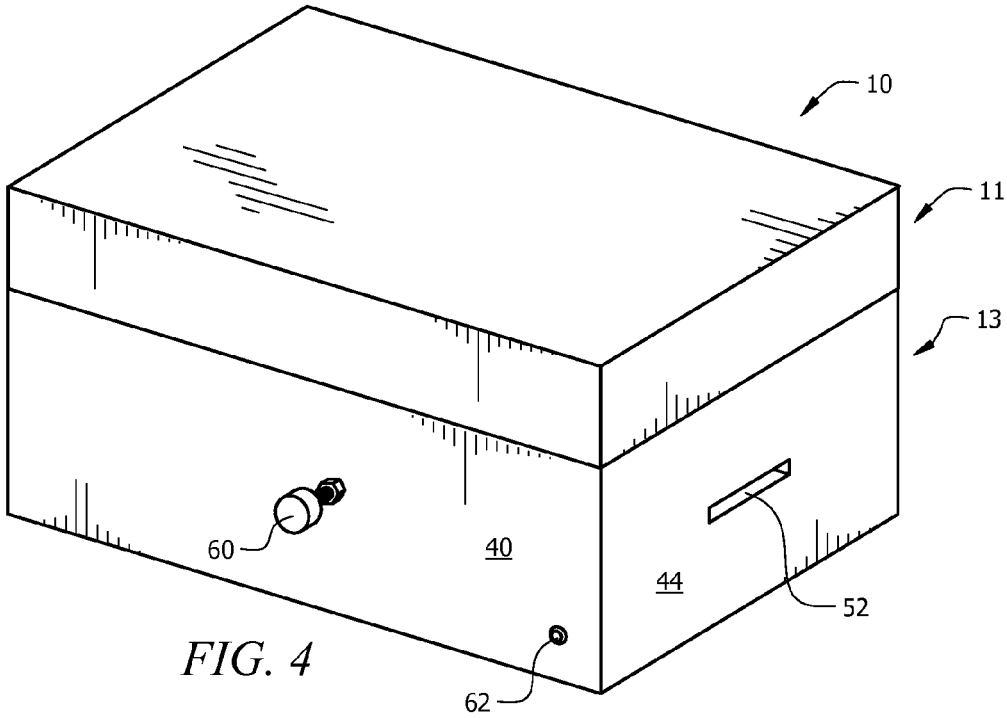
FIG. 4 illustrates a perspective view of the exemplary system of the present invention with the lid shut.

Referring to FIG. 4, a perspective view of the exemplary system of the present invention with the lid shut 11 is shown. In this view, the power switch 60 and indicator 62 are located on the front surface 40 of the base 13 and the vent hole 52 on the right side 44 of the base 11 is visible. The lid 11 is closed, thereby enabling operation of the ultra-violet lamp 24.

Figure 5:
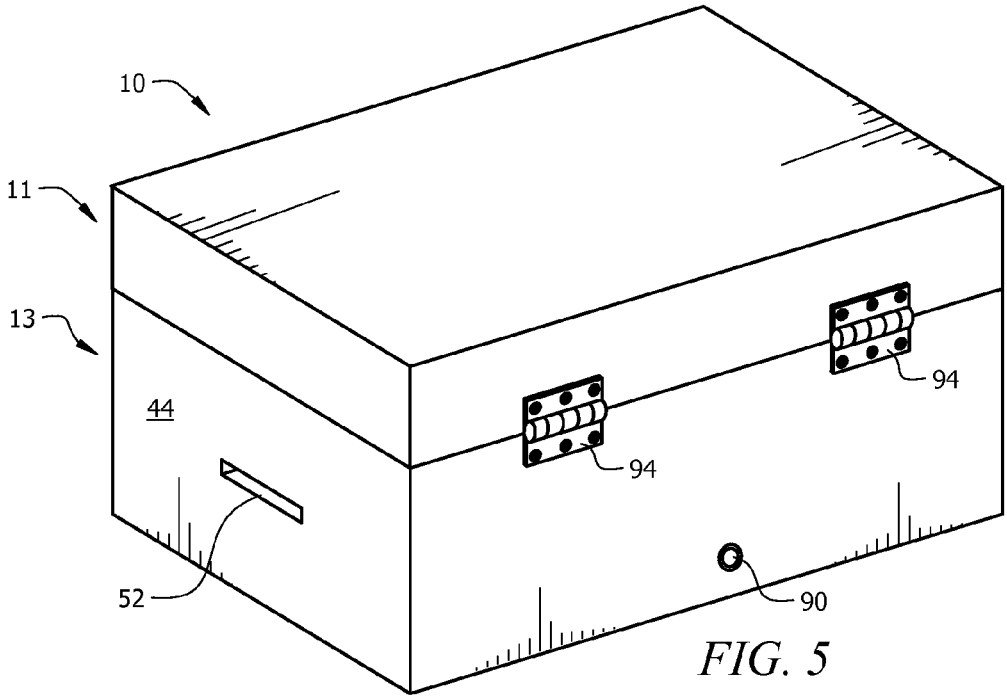
FIG. 5 illustrates a second perspective view of the exemplary system of the present invention with the lid shut.

Referring to FIG. 5, a second perspective view of the exemplary system of the present invention with the lid 11 shut is shown. In this view, a power connector 90 (e.g., a power source or source of power) is located on a rear surface of the base 13 and the vent hole 52 on the right side 44 of the base 11 is visible. The lid 11 is closed, thereby enabling operation of the ultra-violet lamp 24. In this example, the lid 11 is connected to the base 13 by two hinges 94, although, any number of hinges are anticipated.

Figure 6:
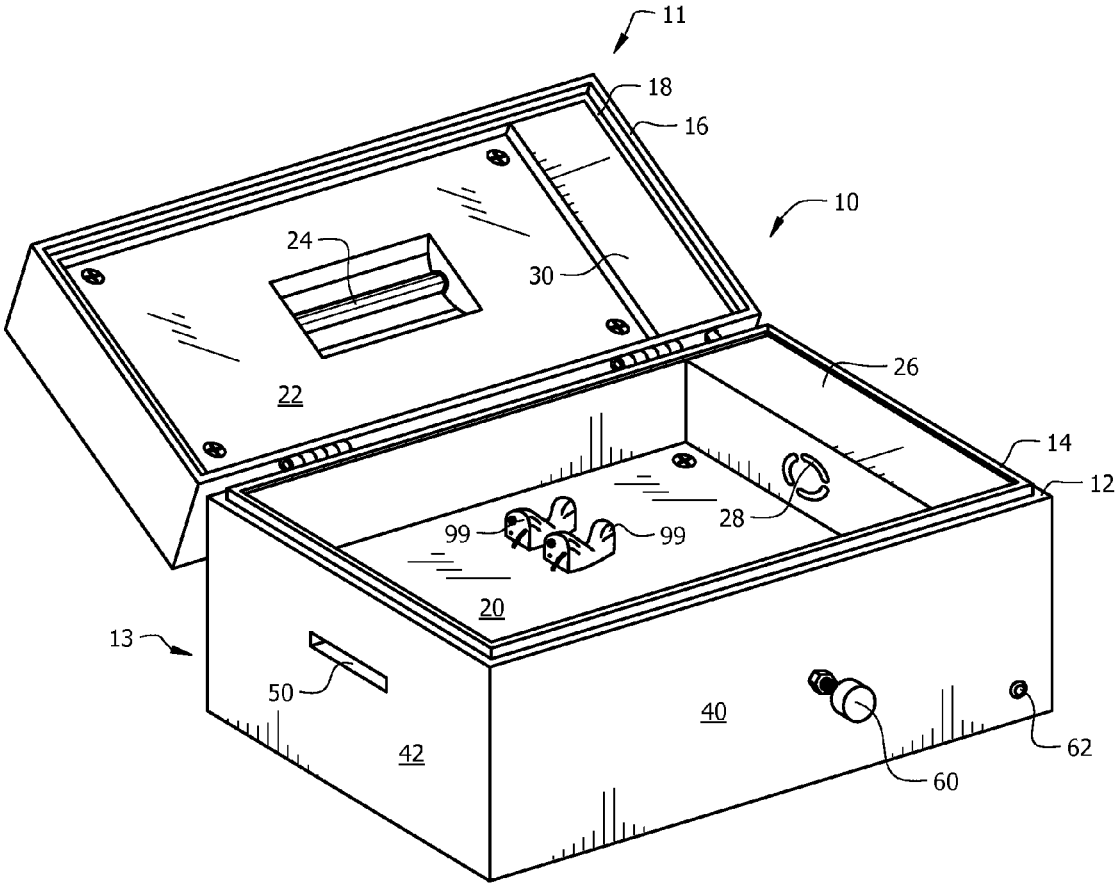
FIG. 6 illustrates a perspective view of an exemplary system of the present invention with the lid open holding a pair of hearing aids.

Referring now to FIG. 6, a perspective view of an exemplary system 10 of the present invention with the lid open holding a pair of hearing aids 99 is shown. The hearing aid(s) 99 or other electrical equipment is placed on the shelf 20 to dry and disinfect when the lid 11 is closed and the on/off switch is operated, energizing the heater 80, fan 81, ultra-violet lamp 24.

Figure 7:
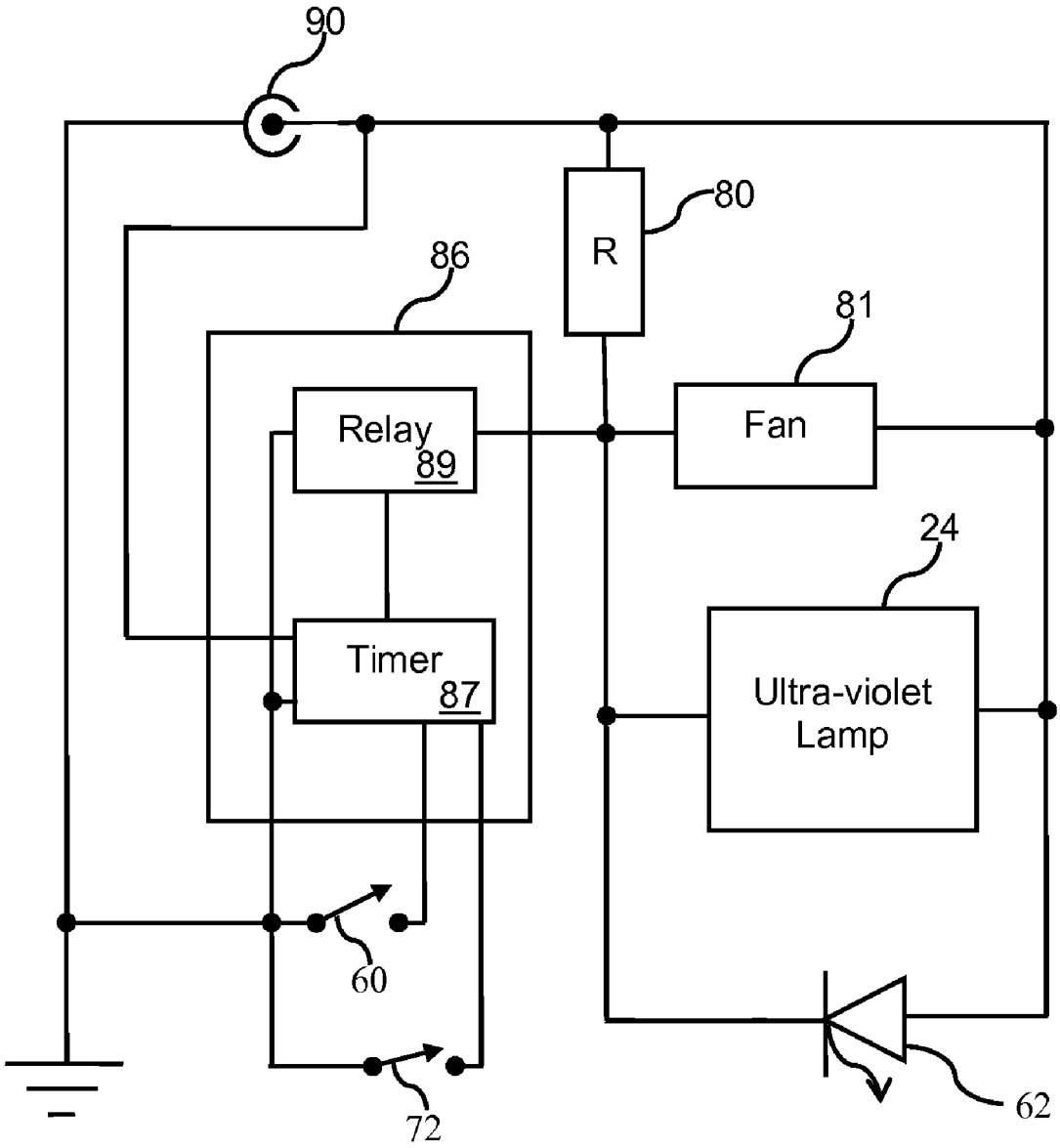
FIG. 7 illustrates a schematic view of an exemplary system of the present invention.

Referring now to FIG. 7, a schematic view of an exemplary system of the present invention will be described. Power is connected through a power jack 90 as known in the industry, one side to ground and the other is connected to the heater 80, fan 81, ultra-violet lamp 24 and indicator 62 (an LED in this example). Power and ground are also provided to a timer 87. When the power switch 60 is pressed (making contact in this example), the timer 87 starts a timing interval. During the timing interval, the timer 87 energizes a relay 89 whose contacts connect the heater 80, fan 81, ultra-violet lamp 24 and indicator 62 (the indicator is optional) to ground potential, thereby powering the heater 80 to heat, fan 81 to move air, ultra-violet lamp 24 to emit ultra-violet light and indicator 62 (optional) to illuminate. When the time interval expires, the timer de-energizes the relay 89 and removes ground potential from the heater 80, fan 81, ultra-violet lamp 24 and indicator 62, thereby turning off these devices.

Many configurations of timers 87 are anticipated. In some configurations, the fan and heater operate independent of the timer (e.g., operate when the power switch 60 is closed) and the ultra-violet lamp 24 is controlled by the timer 87 to operate the ultra-violet lamp 24 for a specific interval such as 5-7 minutes. In another exemplary configuration, the power switch 60 enables the timer 87 and the timer 87 has two intervals, one in hours (e.g., 3-4 hours) to power the fan 81 and heater 80; and another interval in minutes to power the ultra-violet lamp 24 (e.g., 5-7 minutes).

The timer is also connected to the interlock switch 72 which is closed when the lid 11 is shut. If the lid 11 is opened during the timing interval (e.g., the ultra-violet lamp 24 is on), the interlock switch 72 opens (in this example) and signals the timer to cancel the timing interval and, therefore, the timer de-energizes the relay 89 and removes ground potential from the heater 80, fan 81, ultra-violet lamp 24 and indicator 62, thereby turning off these devices.

The timing interval is either pre-set to an optimal amount of time, that required to dry and disinfect most hearing aids or is adjustable (not shown) as known in the industry.

There are many timers known in the industry including electro-mechanical timers (bi-metallic, etc.), clock-movement timers and semiconductor timers, along with many circuit configurations to achieve the same operational results; all are anticipated here within. An exemplary timer is an industry standard 555 timer that is well known. In some cases, the power output of such a timer is sufficient to operate the heater 80, fan 81, ultra-violet lamp 24 without the use of the relay 89. In some exemplary systems, the relay 89 is a semiconductor relay or a power transistor or power FET, as known in the industry.

Since the air in the system 10 and, therefore, the hearing aid 99 is heated by the heating element 80 to a temperature above ambient, for example, 103 C, as air is circulated, moisture is removed from the hearing aid 99 and exhausted from the system 10 through the vents 52/33 while fresh, drier air enters the system through the vents 50/32.

Figure 8:
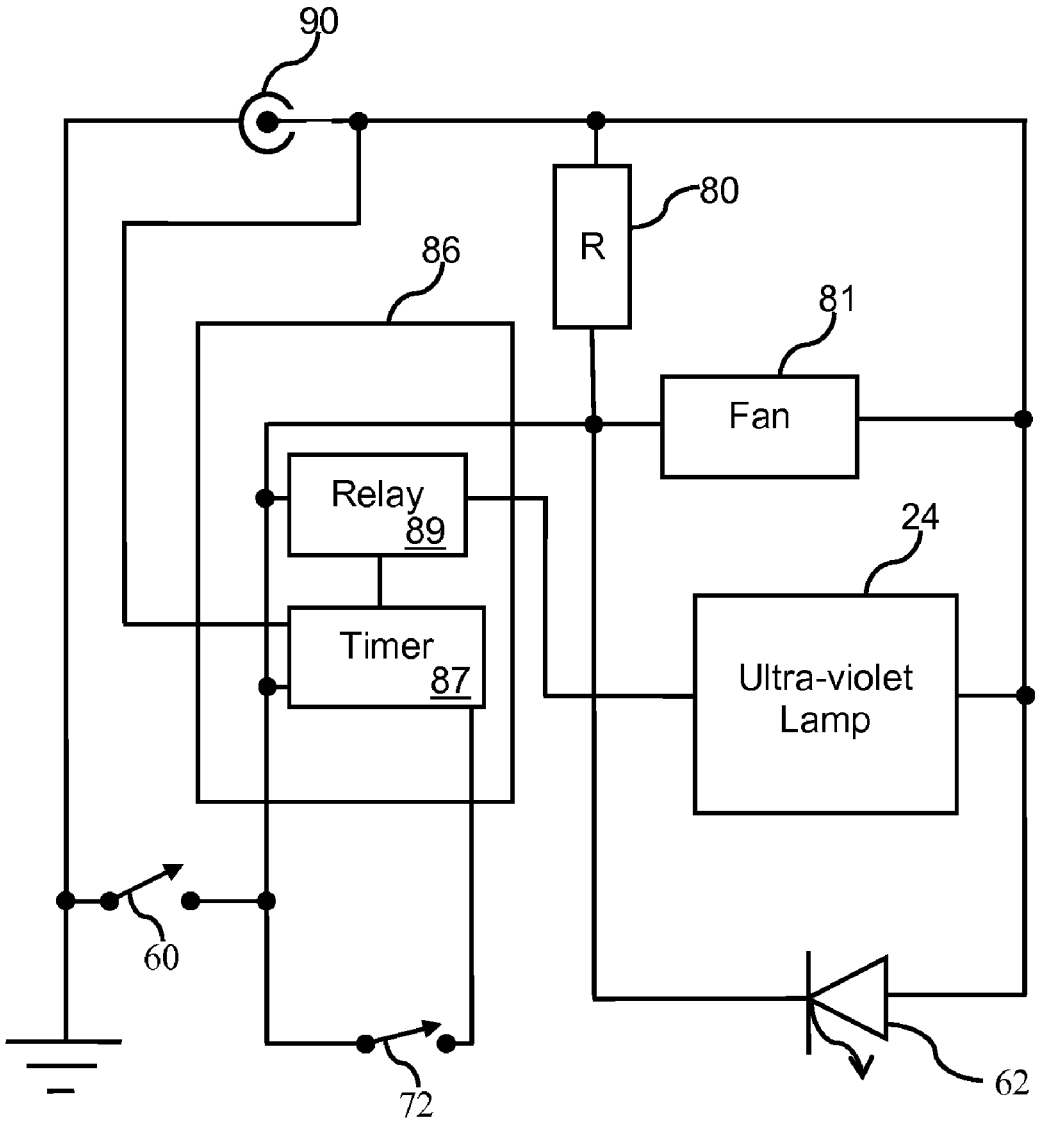
FIG. 8 illustrates a schematic view of a second exemplary system of the present invention.

Referring now to FIG. 8, a schematic view of a second exemplary system of the present invention will be described. In this embodiment, the power switch 60 connects/disconnects power to the entire system such that, when powered, the fan 81, heater 80 and indicator 62 (if provided) are energized whenever the power switch 60 is closed. Also, in this embodiment, the timer 87 is connected to the interlock switch 72 such that the timer 87 starts timing each time the lid 11 is closed or the power switch 60 is turned on (closed). For example, when the lid 11 is closed, the ultra-violet lamp 24 is energized through the timer 87 and optional relay 89 for several minutes such as 5-7 minutes.

As before, Power is connected through a power jack 90 as known in the industry, one side to ground and the other is connected to the heater 80, fan 81, ultra-violet lamp 24 and the optional indicator 62 (an LED in this example). Power and ground are also provided to a timer 87. When the power switch 60 is closed, the heater 80, fan 81 and indicator 62 (the indicator is optional) are connected to ground potential and, therefore, operate. If, the lid 11 is closed, the interlock switch 72 enables the timer 87 to start a timing interval. During the timing interval, the timer 87 energizes a relay 89 whose contacts connect (or transistor conducts current), thereby powering the ultra-violet lamp 24 to emit ultra-violet light. When the time interval expires, the timer de-energizes the relay 89 and removes ground potential from the ultra-violet lamp 24, thereby turning off the ultra-violet lamp 24 and reducing the risk of exposure to the harmful effects of ultra-violet light.

The timing interval is either pre-set to an optimal amount of time, that required to dry and disinfect most hearing aids or is adjustable (not shown) as known in the industry. The timing interval is typically 5-7 minutes, although the present invention is not restricted to any particular timing interval.

There are many timers known in the industry including electro-mechanical timers (bi-metallic, etc.), clock-movement timers and semiconductor timers, along with many circuit configurations to achieve the same or similar operational results; all are anticipated here within. An exemplary timer is an industry standard 555 timer that is well known. In some cases, the power output of such a timer is sufficient to operate the ultra-violet lamp 24 without the use of the relay 89. In some exemplary systems, the relay 89 is a semiconductor relay or a power transistor or power FET, as known in the industry.

Since the air in the system 10 and, therefore, the hearing aid 99 is heated by the heating element 80 to a temperature above ambient, for example, 105 C, as air is circulated, moisture is removed from the hearing aid 99 and exhausted from the system 10 through the vents 52/33 while fresh, drier air enters the system through the vents 50/32.

Equivalent elements can be substituted for the ones set forth above such that they perform in substantially the same manner in substantially the same way for achieving substantially the same result.

It is believed that the system and method of the present invention and many of its attendant advantages will be understood by the foregoing description. It is also believed that it will be apparent that various changes may be made in the form, construction and arrangement of the components thereof without departing from the scope and spirit of the invention or without sacrificing all of its material advantages. The form herein before described being merely exemplary and explanatory embodiment thereof. It is the intention of the following claims to encompass and include such changes.

What is claimed is:

1. A drying system for a hearing aid, the drying system comprising:

an enclosure, the enclosure comprising a lid portion and a base portion, the lid portion hingedly connected to the base portion;

an ultra-violet lamp adapted to emit ultra-violet light, at least some of the ultra-violet light directed towards the hearing aid;

a shelf within the base portion, the shelf adapted to supporting the hearing aid;

a heater disposed within the base portion and beneath the shelf;

at least two air vents in the base portion, each of the at least two air vents comprising an inner air vent and an outer air vent, whereas the inner air vent is staggered with respect to the outer air vent, thereby reducing leakage of the ultra-violet light;

a fan disposed within the base portion, the fan drawing air into the drying system through a first air vent of the at least two air vents and the fan pushing air out of the drying system through a second air vent of the at least two air vents;

a power source connected to the fan, the heater and the ultra-violet lamp through a power switch.

2. The drying system of claim 1, further comprising a timer interfaced between the power source and the fan, the heater and the ultra-violet lamp, the timer adapted to connect the power source to the fan, the heater and the ultra-violet lamp during a timer interval.

3. The drying system of claim 1, further comprising a timer interfaced between the power source and the ultra-violet lamp, the timer adapted to connect the power source to the ultra-violet lamp during a timer interval.

4. The drying system of claim 1, further comprising an interlock switch interfaced between the power source and the fan, the heater and the ultra-violet lamp; the interlock switch operatively coupled between the lid portion and the base portion and the interlock switch adapted to disconnect the power source from the fan, the heater and the ultra-violet lamp responsive to the interlock switch detecting a separation between the lid portion and the base portion.

5. The drying system of claim 3, further comprising an interlock switch interfaced between the power source and the timer; the interlock switch operatively coupled between the lid portion and the base portion and the interlock switch adapted to reset the timer, thereby disconnecting the power source from the ultra-violet lamp responsive to the interlock switch detecting a separation between the lid portion and the base portion and the interlock switch adapted to start the timer responsive to detecting a closure of the lid portion to the base portion.

6. The drying system of claim 4, wherein the interlock switch consists of a magnet disposed in the lid portion and a reed switch disposed in the base portion whereas the reed switch is adapted to disconnect the power source from the fan, the heater and the ultra-violet lamp responsive to an abatement of magnetic field that occurs when the lid portion is hingedly separated from the base portion.

7. The drying system of claim 1, wherein the second air vent is adjacent to the fan.

8. The drying system of claim 1, wherein a top surface of the shelf is mirrored to reflect the ultra-violet light and a portion of the inside surface of the lid is mirrored to reflect the ultra-violet light.

9. The drying system of claim 1, wherein the lid portion comprises an inner lid and an outer lid, the outer lid having an outer lid interface edge and an inner lid interface edge, the outer lid interface edge protruding beyond the inner lid interface edge; the base portion comprises an inner base and an outer base, the outer base having an outer base interface edge and an inner base interface edge, the inner base interface edge protruding beyond the inner base interface edge, whereas the outer lid interface edge interfaces to the outer base interface edge and the inner base interface edge interfaces with the inner lid interface edge, thereby reducing emission of the ultra-violet light from the drying system.

10. A drying system for a hearing aid, the drying system comprising:

an enclosure, the enclosure comprising a lid portion and a base portion, the lid portion hingedly connected to the base portion;

an ultra-violet lamp adapted to emit ultra-violet light, at least some of the ultra-violet light directed towards the hearing aid;

a shelf within the base portion, the shelf adapted to supporting the hearing aid;

a heater disposed within the base portion and beneath the shelf;

at least two air vents in the base portion, each of the at least two air vents comprising an inner air vent and an outer air vent, whereas the inner air vent is staggered with respect to the outer air vent, thereby reducing leakage of the ultra-violet light;

a fan disposed within the base portion, the fan drawing air into the drying system through a first air vent of the at least two air vents and the fan pushing air out of the drying system through a second air vent of the at least two air vents;

a power source;

a power switch, the power switch adapted to connect the fan, the ultra-violet lamp and the heater to the power source when the power switch is closed;

a timer interfaced between the power source and the the ultra-violet lamp, the timer adapted to connect the power source to the ultra-violet lamp during a timer interval; and an interlock switch, the interlock switch interfaced to the timer; the interlock switch operatively coupled between the lid portion and the base portion; and the interlock switch adapted to disable the ultra-violet lamp upon detection of an open condition between the base portion and the lid portion and the interlock switch adapted to initiate the timer interval upon detection of a closed condition between the base portion and the lid portion.

11. The drying system of claim 10, wherein the interlock switch consists of a magnet disposed in the lid portion and a reed switch disposed in the base portion.

12. The drying system of claim 10, wherein a top surface of the shelf is mirrored to reflect the ultra-violet light and a portion of the inside surface of the lid is mirrored to reflect the ultra-violet light.

13. The drying system of claim 10, wherein the heater is a resistive heater.

14. The drying system of claim 10, wherein the lid portion comprises an inner lid and an outer lid, the outer lid having an outer lid interface edge and an inner lid interface edge, the outer lid interface edge protruding beyond the inner lid interface edge; the base portion comprises an inner base and an outer base, the outer base having an outer base interface edge and an inner base interface edge, the inner base interface edge protruding beyond the inner base interface edge, whereas the outer lid interface edge interfaces to the outer base interface edge and the inner base interface edge interfaces with the inner lid interface edge, thereby reducing emission of the ultra-violet light from the drying system.

15. A drying system for a hearing aid, the drying system consisting of:

an enclosure, the enclosure comprising a lid portion and a base portion, the lid portion hingedly connected to the base portion;

an ultra-violet lamp adapted to emit ultra-violet light, at least some of the ultra-violet light directed towards the hearing aid;

a shelf within the base portion, the shelf adapted to supporting the hearing aid;

a heater disposed within the base portion and beneath the shelf;

at least two air vents in the base portion, each of the at least two air vents comprising an inner air vent and an outer air vent, whereas the inner air vent is staggered with respect to the outer air vent, thereby reducing leakage of the ultra-violet light;

a fan disposed within the base portion, the fan drawing air into the drying system through a first air vent of the at least two air vents and the fan pushing air out of the drying system through a second air vent of the at least two air vents;

a power source;

a timer interfaced between the power source and the ultra-violet lamp; the timer adapted to operate the ultra-violet lamp during a timer interval;

an interlock switch interfaced to the timer; the interlock switch operatively coupled between the lid portion and the base portion and the interlock switch adapted to signal the timer to disconnect power to the ultra-violet lamp responsive to the interlock switch detecting a separation between the lid portion and the base portion and the interlock switch adapted to signal the timer to initiate the timer interval responsive to the interlock switch detecting a closure between the lid portion and the base portion; and a power switch, the power switch adapted to provide power to the fan, the heater and the timer when the power switch is closed.

16. The drying system of claim 15, wherein the second air vent is adjacent to the fan.

17. The drying system of claim 15, wherein the interlock switch consists of a magnet disposed in the lid portion and a reed switch disposed in the base portion.

18. The drying system of claim 15, wherein a top surface of the shelf is mirrored to reflect the ultra-violet light and a portion of the inside surface of the lid is mirrored to reflect the ultra-violet light.

19. The drying system of claim 15, wherein the heater is a resistive heater.

20. The drying system of claim 15, wherein the lid portion consists of an inner lid and an outer lid, the outer lid having an outer lid interface edge and an inner lid interface edge, the outer lid interface edge protruding beyond the inner lid interface edge; the base portion comprises an inner base and an outer base, the outer base having an outer base interface edge and an inner base interface edge, the inner base interface edge protruding beyond the inner base interface edge, whereas the outer lid interface edge interfaces to the outer base interface edge and the inner base interface edge interfaces with the inner lid interface edge, thereby reducing emission of the ultra-violet light from the drying system.

* * * * *